US007946547B2

(12) United States Patent
Bernstorf et al.

(10) Patent No.: US 7,946,547 B2
(45) **Date of Patent: *May 24, 2011**

(54) UNIVERSAL CLAMP

(75) Inventors: Robert A. Bernstorf, Rittman, OH (US); Kiran K. Pusthay, Wadsworth, OH (US); Joseph V. Roth, Jr., Akron, OH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/318,423

(22) Filed: Dec. 29, 2008

(65) Prior Publication Data

US 2009/0194658 A1 Aug. 6, 2009

Related U.S. Application Data

(63) Continuation-in-part of application No. 11/790,690, filed on Apr. 26, 2007, now Pat. No. 7,588,224.

(51) Int. Cl.
*A47B 96/06* (2006.01)

(52) U.S. Cl. ..... 248/229.22; 248/229.24; 248/229.25

(58) Field of Classification Search ..... 248/229.22, 248/229.24, 229.25, 229.12, 229.14, 229.15, 248/316.4, 316.6, 230.3, 230.5, 230.6, 231.41, 248/231.61, 231.71, 244.45, 268; 269/244, 269/45, 268, 249, 250, 246, 252, 253; 174/40 TD, 174/45 TD, 40 CC; 285/420
See application file for complete search history.

(56) References Cited

U.S. PATENT DOCUMENTS

| | | | |
|---|---|---|---|
| 2,779,815 | A | 1/1957 | Sokol |
| 2,786,885 | A | 3/1957 | Wilson |
| 3,026,368 | A | 3/1962 | Lindsey |
| 3,267,206 | A | 8/1966 | Leonard, Jr. |
| D209,668 | S | 12/1967 | Lindsey |
| D213,049 | S | 12/1968 | Lindsey |
| 3,437,742 | A | 4/1969 | Lindsey |
| 3,437,743 | A | 4/1969 | Lindsey |
| 3,553,351 | A | 1/1971 | Lindsey |
| 3,556,506 | A | 1/1971 | Welker |
| 3,623,687 | A | 11/1971 | Nordstrom |
| 3,706,436 | A | 12/1972 | Lindsey |
| 3,737,560 | A | 6/1973 | Takatori et al. |
| 3,836,102 | A | 9/1974 | Hall |
| 3,872,267 | A | 3/1975 | Kerr |
| 4,178,470 | A | 12/1979 | Jean et al. |
| 4,258,228 | A | 3/1981 | Jean et al. |

(Continued)

FOREIGN PATENT DOCUMENTS

| | | |
|---|---|---|
| JP | 8069725 | 3/1996 |

*Primary Examiner* — A. Joseph Wujciak, III
(74) *Attorney, Agent, or Firm* — Jenae C. Gureff; Mark S. Bicks; Alfred N. Goodman

(57) ABSTRACT

A universal clamp assembly for receiving an electrical conductor having a variety of diameters without exchanging parts. An insulator includes a support fitting thereon. The clamp assembly includes a keeper fixed to an end of the fitting with two guide arms disposed along two sides thereof. An internally threaded bore in the keeper has a longitudinal axis. An externally threaded bolt is threadedly received in the bore. The assembly also includes a clamp member relatively rotatably receiving and axially restraining the bolt and located adjacent to the keeper for translational movement of the clamp member relative to the keeper along the longitudinal axis of the bolt. The clamp member includes two axially extending sliding arms adjacent the two guide arms. Rotation of the bolt along the longitudinal axis moves the clamp member towards and away from the keeper.

21 Claims, 4 Drawing Sheets

U.S. PATENT DOCUMENTS 4,579,306 A 4/1986 Kellett et al.
4,727,224 A 2/1988 Kellett et al.
5,064,971 A * 11/1991 Bogdanow ..... 174/169
5,435,507 A 7/1995 Murphy
5,837,943 A 11/1998 Kellett
7,432,449 B2 * 10/2008 Kim ..... 174/138 F
7,588,224 B2 * 9/2009 Bernstorf et al. ..... 248/229.22
2008/0083555 A1 4/2008 Kim

* cited by examiner

UNIVERSAL CLAMP

This application is a continuation-in-part of and claims the benefit of U.S. patent application Ser. No. 11/790,690, (now U.S. Pat. No. 7,588,224), filed Apr. 26, 2007, the subject matter of which application is hereby incorporated herein by reference in its entirety.

FIELD OF THE INVENTION

The present invention relates to a universal clamp assembly for holding electrical conductors of various sizes without exchanging parts. More particularly, the invention relates to a clamp assembly for holding conductors of various sizes without exchanging parts. The clamp assembly is mounted atop an insulator having an end fitting. The insulator can be mounted vertically or horizontally.

BACKGROUND OF THE INVENTION

Conventional clamp and insulator assemblies are unable to accommodate a variety of sizes without interchanging parts. Common mechanical clamps used in conjunction with insulators as a multi-piece system present a number of problems, including wasting time and material. Another issue is the difficulty of performing line maintenance with separate insulators and clamps because the use of removable bolts and washers increases the chances of a lineman dropping parts during installation or losing parts during storage and handling operations.

The requirement for different insulators for horizontal and vertical mountings leads to an increase in the number and types of insulators. Sometimes as many as three different clamp sizes may be required for securing conductors of different diameters. Typical insulator and clamp arrangements require repairs that replace the insulator, the clamp, or both. Using a multi-piece clamp and insulator assembly, a lineman must be extremely cautious to avoid dangerous consequences.

Accordingly, a need exists for providing a universal clamp mounted on a support fitting atop an insulator that can grasp conductors of various sizes without exchanging parts. Further, a need exists for providing a universal conductor clamp such that the shape of the clamp saddle and keeper accommodate horizontal and vertical mounting.

SUMMARY OF THE INVENTION

Accordingly, an object of the present invention is to provide a clamp assembly for controlling the position of a clamp saddle with respect to a keeper by fixing a threaded keeper to the end fitting of the insulator with a bolt passing therethrough.

Another object of the invention is to provide a conductor clamp assembly for grasping conductors of varying sizes without exchanging parts by rotating a bolt to move a clamp saddle relative to the keeper such that the conductor is clamped therebetween.

A further object of the invention is to provide a conductor clamp assembly having a clamp saddle and keeper with a shape that allows for horizontal and vertical mounting of the insulator.

Still another object of the invention is to provide a clamp saddle having first and second sliding arms disposed on opposite sides of the keeper between first and second guide arms of said keeper to maintain alignment of the clamp saddle with the keeper.

Accordingly, yet another object of the invention is to provide a universal clamp assembly with a bolt for allowing the clamp saddle to move along the axis of the bolt while the keeper is fixed to the end fitting.

Yet another object of the invention is to provide a universal clamp assembly designed with a clamp having outwardly flaring and curved ends to accommodate the sag or pull-off angles of the conductor.

A further object is to provide a universal clamp assembly having the keeper mounted on an end fitting with a threaded bolt mounted to the clamp saddle and through the keeper controlling the back and forth movement therebetween.

The foregoing objects are basically attained by providing a universal clamp assembly mounted atop an insulator having an end fitting. The insulator can be mounted vertically or horizontally onto a surface. The clamp assembly includes a keeper fixed to an end of the fitting with two guide arms disposed along two sides thereof. An internally threaded bore in the keeper has a longitudinal axis. An externally threaded bolt is threadedly received in the bore. The assembly also includes a clamp member relatively rotatably receiving and axially restraining the bolt and located adjacent to the keeper for translational movement of the clamp member relative to the keeper along the longitudinal axis of the bolt. The clamp member includes two axially extending sliding arms adjacent the two guide arms. Rotation of the bolt along the longitudinal axis moves the clamp member towards and away from the keeper.

As used in this application, the terms "top", "bottom", and "side" are intended to facilitate the description of the invention, and are not intended to limit the present invention to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
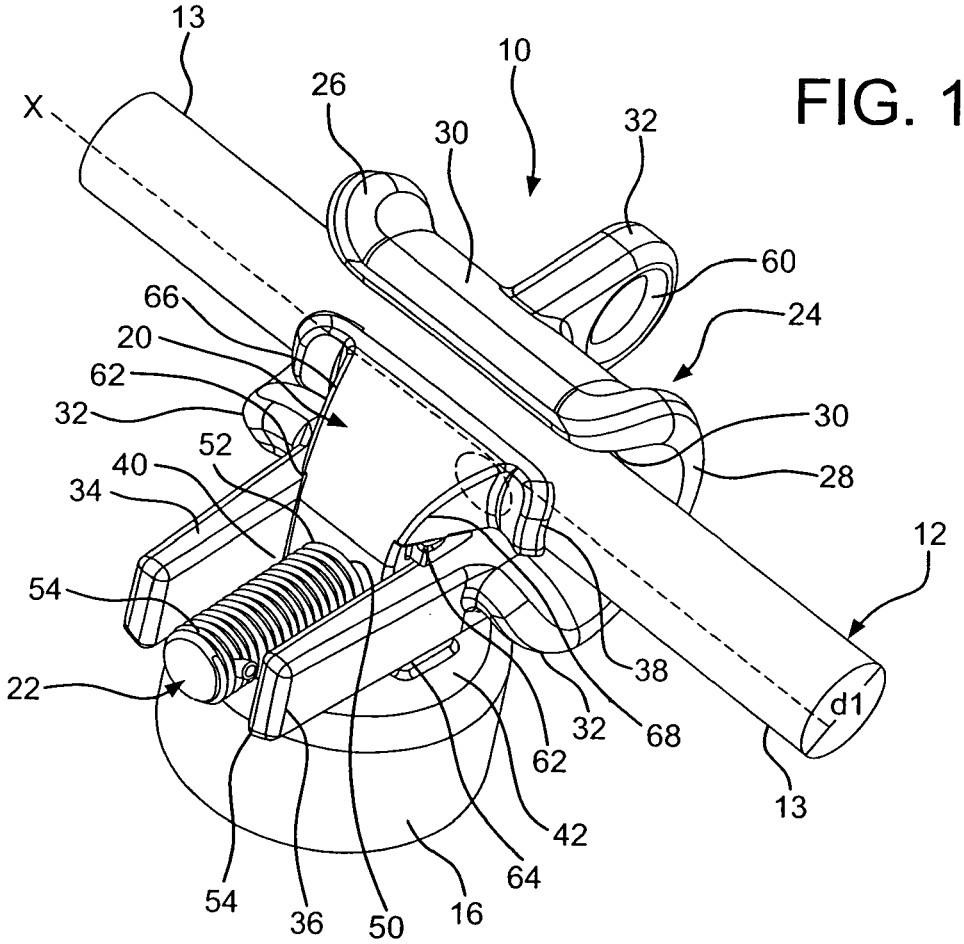
FIG. 1 is a front perspective view of the universal clamp according to an embodiment of the present invention with a cable received in the clamp and the clamp saddle disposed in the clamping position.

As seen in FIGS. 1-4, a universal clamp assembly 10 includes a support fitting 16 mounted atop an insulator 18 and crimped onto one of the insulator ends 19. The clamp assembly 10 includes a keeper 20 fixed to an end of the support fitting 16. The keeper 20 threadedly receives a threaded bolt 22 coupled to a clamp member 24 for rotation about the longitudinal axis of the bolt 22 in the clamp member 24 for movement of the clamp member 24 towards the keeper 20 along a longitudinal axis x of the bolt 22. The bolt 22 is restrained against axial movement relative to the clamp member 24. The clamp member 24 includes a saddle 30 disposed between first and second contoured ends 26, 28 and a frame 32 having first and second sliding arms 34, 36 extending therefrom and surrounding the bolt 22. The keeper 20 includes guide arms 62, 64 engaging the sliding arms 34, 36 as the bolt 22 moves the clamp member 24 towards and away from the keeper 20. This engagement restrains the clamp member 24 against rotational movement relative to the keeper 20, while allowing axial movement therebetween.

The universal feature of the clamp assembly 10 to contain a variety of electrical conductors 12 having multiple diameters d1 is captured by the variable distance d2 between the inside surface 38 of the keeper 20 and the saddle 30 of the clamp member 24. Both the inside surface 38 and the saddle 30 are concavely curved and oriented against the exterior walls 13 of the conductor 12. The forward and backward movement traveled by the clamp member 24 with respect to the keeper 20 and the top surface 42 of the end fitting 16 is controlled by rotating the bolt 22.

Figure 5:
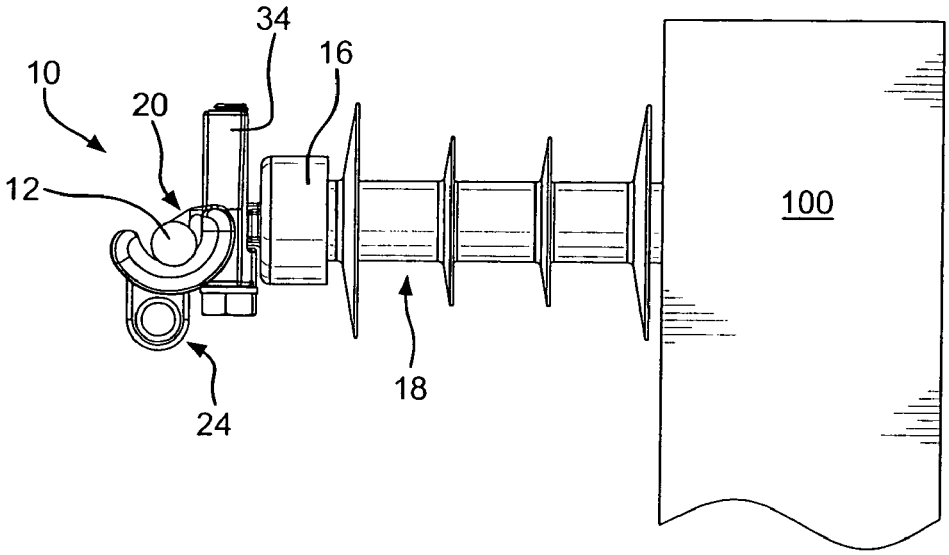
FIG. 5 is a side elevational view of the universal clamp according to FIGS. 1-4 illustrating the horizontal mounting of the assembly.
Figure 6:
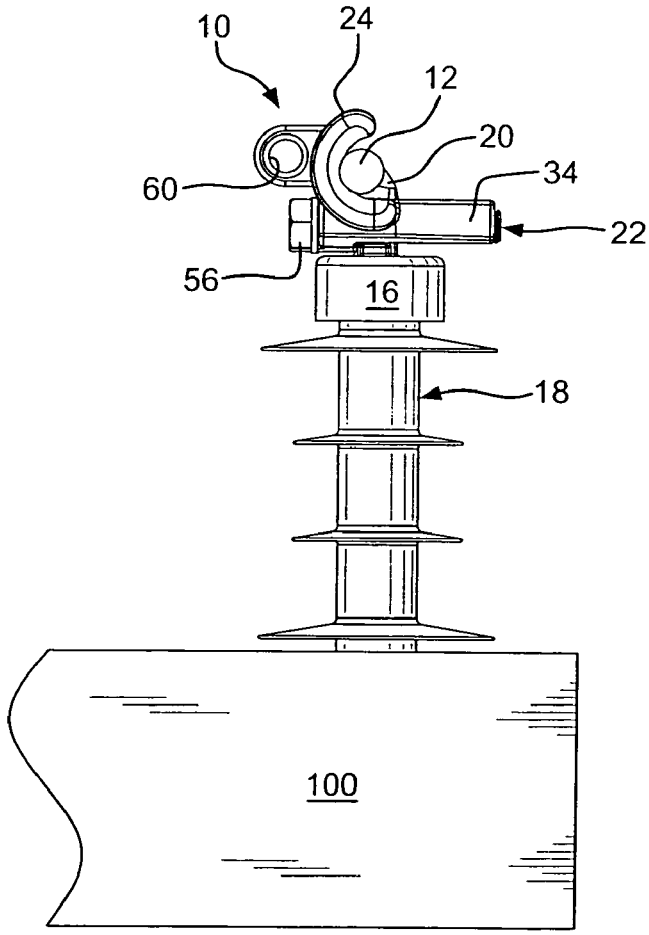
FIG. 6 is a side elevational view of the universal clamp according to FIGS. 1-5 illustrating the vertical mounting of the assembly.

Both the support fitting 16 and the insulator 18 are of a conventional design. The clamp assembly 10 is configured such that the insulator 18 can be mounted to a surface 100 horizontally (as seen in FIG. 5) or vertically (as seen in FIG. 6).

Rotating the bolt 22 increases, or decreases, the distance between the axially fixed position keeper 20 and the adjustable position clamp member 24. As the clamp member 24 moves along the longitudinal axis of the bolt 22, the distance between the keeper 20 and the clamp member 24 is adjusted to accommodate the electrical conductor 12 therebetween.

Distance d2 is directly proportional to the diameter d1 of the conductor 12 received therebetween. For example, as the size of the conductor 12 diameter d1 increases so too does the distance d2 between the keeper 20 and the saddle 30. The distance d2 is equivalent to the diameter of the conductor 12 or distance d1.

The clamp assembly 10 includes a clamp member 24 journaled onto the bolt 22 for allowing rotation of the bolt 22 relative to the bolt 22 relative to the clamp member 24, support fitting 16, and keeper 20. The bolt 22 extends into a guide opening 40 formed between first and second sliding arms 34, 36 of the clamp member 24. The keeper 20 is threadedly mounted on the bolt 24 and received in the opening 40 between the sliding arms 34, 36. The keeper 20 is restrained against axial movement relative to the support fitting 16 along the longitudinal axis. The clamp member 24 slides along the longitudinal axis and is restrained against rotation about the longitudinal axis relative to the keeper 20 because of the guide arms 62, 64 and their engagement with the sliding arms 34, 36.

The clamp member 24 is substantially J-shaped having a first longitudinal end 44 and a substantially rectangular-shaped second longitudinal end 46 adjacent to first and second arms 34, 36 with guide opening 40 therebetween. The clamp member 24 is further defined by a concavely curved saddle 30 disposed at the first end 44 and extending between contoured ends 26, 28. The contoured ends 26, 28 flare outwardly and are curved to face away from the conductor 12 to provide secure clamping of the conductor 12, while simultaneously preventing and eliminating any abrasion of the conductor 12. The clamp member 24 further includes an opening 60 adjacent the first longitudinal end 44.

Figure 2:
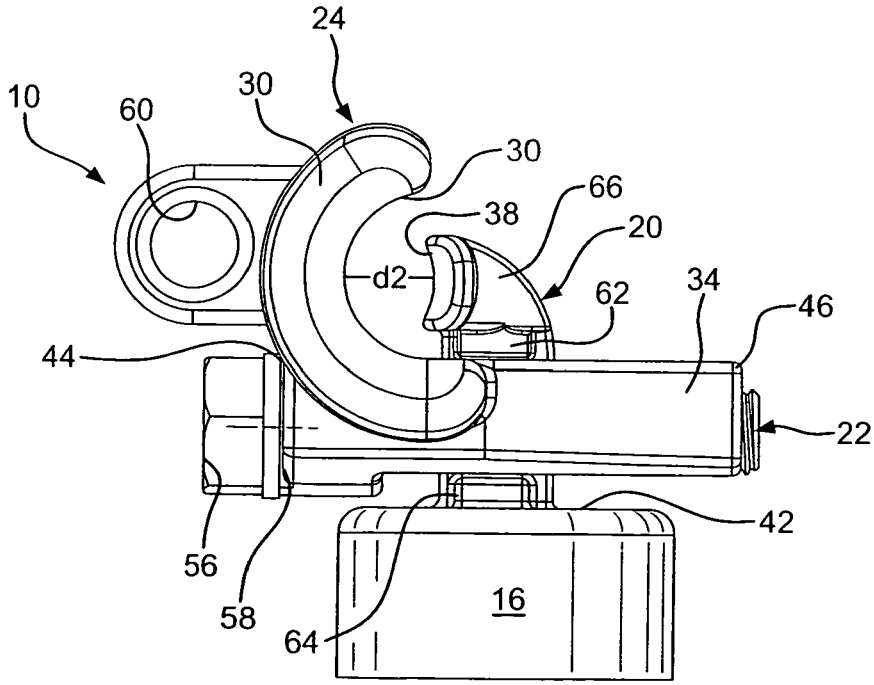
FIG. 2 is a side elevational view of the universal clamp according to FIG. 1 with the cable removed from between the clamp and the keeper.
Figure 3:
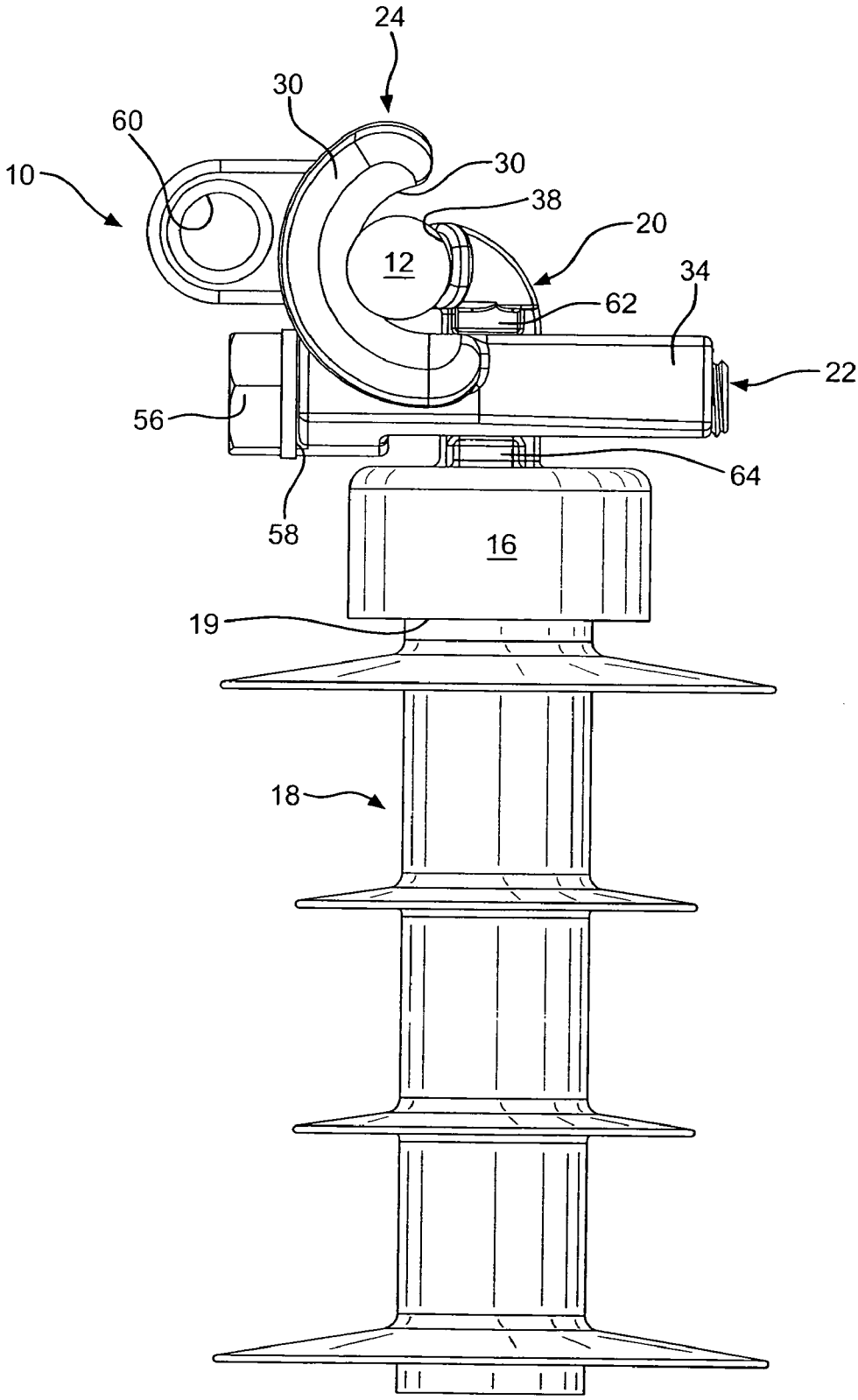
FIG. 3 is a side elevational view of the universal clamp according to FIGS. 1 and 2 with a cable received in the clamp and the clamp saddle disposed in the clamping position with a full view of the end-fitting atop an insulator.
Figure 4:
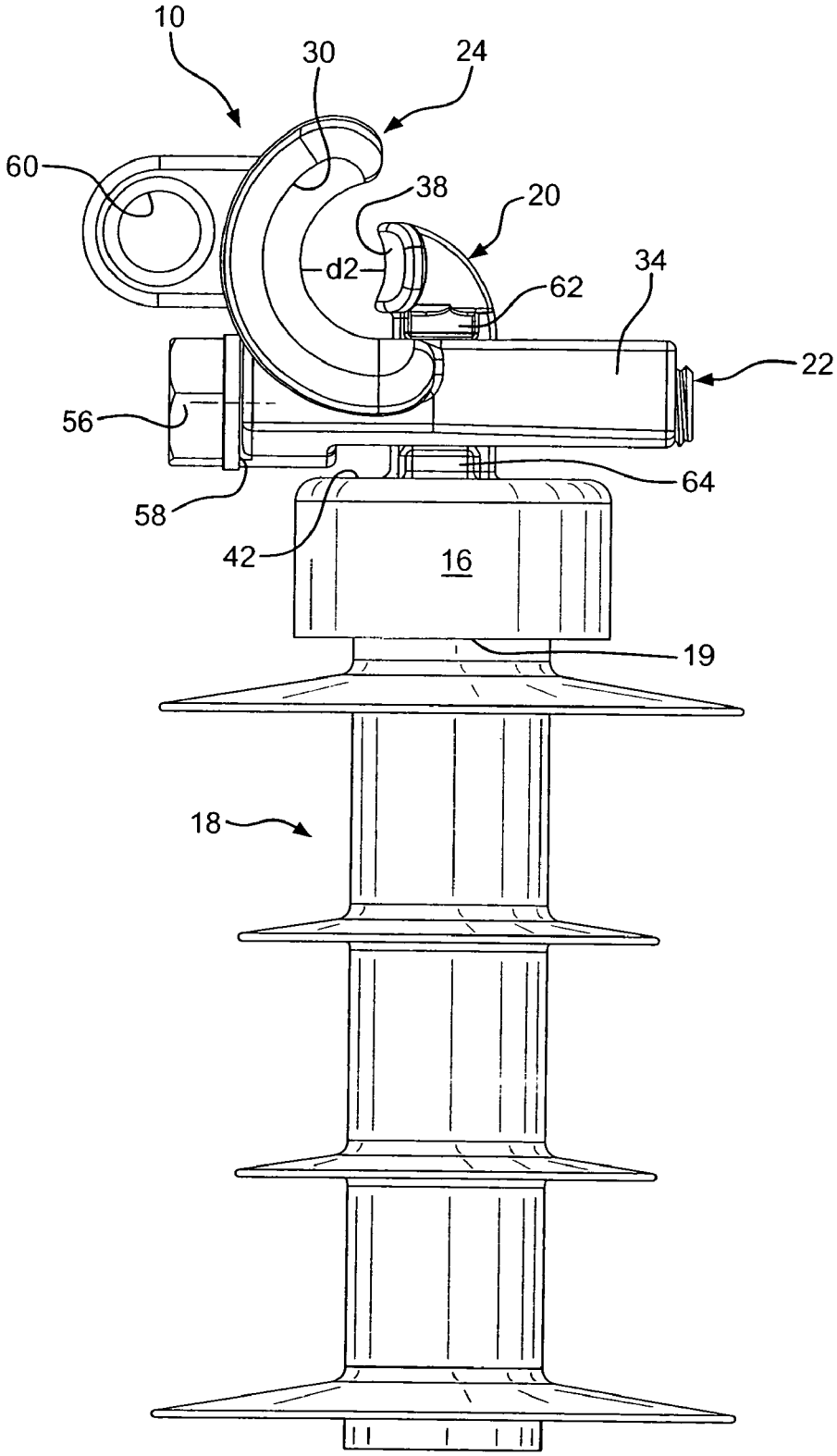
FIG. 4 is a side elevational view of the universal clamp according to FIGS. 1-3 with the cable removed from between the clamp saddle and the keeper.

Turning now to FIG. 2, the size of the keeper 20 is substantially smaller than that of the clamp member 24. The inside surface 38 of the keeper 20 is concavely curved for fitting smoothly against the conductor 12 at the side of the conductor opposite the saddle 30. The keeper 20 includes a rectangular bottom portion 50 having an internally threaded bore 52 receiving the threads 54 of the bolt 22. The rectangular bottom portion 50 is received in guide opening 40 between first and second arms 34, 36. Thus, the clamp member 24 moves along the longitudinal axis of the bolt 22 upon bolt 22 rotation. More specifically, the keeper 20 receives the threads 54 of the bolt 22 as the saddle 30 moves towards the keeper surface 38 for securing the conductor 12.

The keeper 20 includes another feature to align its interior surface 38 with the saddle 30. The keeper 20 is further defined by first and second guide arms 62, 64 along the first and second sides 66, 68 of the keeper 20. The guide arms 62, 64 align the sliding arms 34, 36 of the clamp member 24 as the bolt 22 is rotated and the clamp member 24 moves towards and away from the keeper 20. The guide arms 62, 64 project laterally from the rectangular bottom portion 50 of the keeper 20 and engage the sliding arms 34, 36. Preferably, the upper guide arms 62 project from the rectangular bottom portion 50 and over the sliding arms 34, 36. The lower guide arms 64 project from the rectangular bottom portion 50 and are disposed beneath the sliding arms 34, 36.

Best seen in FIG. 1, the bolt 22 extends beyond both arms 34, 36 of the clamp member 24. The end of the bolt 22 furthest from the keeper 20 is defined by a hex head 56 adjacent to a washer 58 surrounding the body of the bolt 22. The threads 54 of the bolt 22 are always engaged with the keeper 20, while having enough space within guide opening 40 to allow for movement of the clamp member 24 to correspond to the diameter of the conductor 12.

Together, the connection between the support fitting 16 and the threaded bolt 22 secures the electrical conductor 12 to the clamp assembly 10 and retains the axial position of the keeper 20 until the clamp member 24 moves away from the keeper 20. The arrangement of the bolt 22 enables the clamp member 24 to slide along the longitudinal axis of the bolt 22 without passing completely through the support fitting 16.

While a particular embodiment has been chosen to illustrate the invention, it will be understood by those skilled in the art that various changes and modifications can be made therein without departing from the scope of the invention as defined in the appended claims.

What is claimed is:

1. A clamp assembly comprising:

an insulator having a support fitting thereon;

a keeper fixed to an end of said fitting having spaced first and second guide arms disposed along each of first and second sides thereof;

an internally threaded bore in said keeper and having a longitudinal axis;

an externally threaded bolt threadedly received in said bore; and a clamp member relatively rotatably and unthreadedly receiving said bolt and being located adjacent said keeper for translational movement of said clamp member relative to said keeper along said longitudinal axis of said bolt, said clamp member having first and second axially extending sliding arms adjacent and between the respective first and second guide arms;

whereby rotation of said bolt about the longitudinal axis moves said clamp member towards and away from said keeper.

2. The clamp assembly according to claim 1 wherein said keeper and said bolt are received in an opening between first and second sliding arms.

3. The clamp assembly according to claim 2 wherein said keeper includes a rectangular bottom end surrounding said threaded bore.

4. The clamp assembly according to claim 2 wherein said clamp member includes first and second longitudinal ends with a saddle at said first end and said opening extending from said second end toward said keeper.

5. The clamp assembly according to claim 4 wherein said saddle includes outwardly flaring end sections that are curved away from an electrical conductor received therein.

6. The clamp assembly according to claim 5 wherein said first and second guide arms project laterally from a bottom portion of said keeper and engage said first and second sliding arms.

7. The universal clamp according to claim 6 wherein said keeper restrains said clamp member against relative rotational movement relative to the keeper while allowing relative axial movement therebetween.

8. The clamp assembly according to claim 1 wherein said bolt is journaled in said clamp member.

9. The clamp assembly according to claim 1 wherein said keeper includes a substantially curved surface opposite a saddle of said clamp member, said curved surface configured to receive a conductor.

10. The clamp assembly according to claim 1 wherein said clamp member further includes a saddle having first and second contoured ends defined by a base therebetween.

11. The clamp assembly according to claim 1 wherein said clamp member includes a frame with said first and second sliding arms extending therefrom.

12. The clamp assembly according to claim 1 wherein said bolt is threadedly received by a bore for moving said clamp member between said first and second guide arms.

13. The clamp assembly according to claim 1 wherein a washer is mounted onto said bolt adjacent said clamp member for axially restraining said bolt relative to said clamp member.

14. The clamp assembly according to claim 1 wherein said support fitting is mounted on an insulator.

15. The clamp assembly according to claim 1 wherein said first and second sliding arms are cantilevered and attached to said clamp member at interior ends thereof and open at opposing exterior ends thereof.

16. A clamp assembly comprising:

an insulator having a support fitting thereon;

a keeper fixed to an end of said support fitting having first and second guide arms disposed along first and second sides thereof, a rectangular bottom portion extending therebetween, said bottom portion having a threaded bore;

an internally threaded bore in said keeper and having a longitudinal axis;

an externally threaded bolt threadedly received in said bore; and a clamp member relatively rotatably receiving and axially restraining said bolt and being located adjacent said keeper and having first and second ends with a saddle at said first end and an opening extending from said second end, first and second axially extending sliding arms adjacent said opening and received between first and second guide arms for translational movement of said clamp member towards said keeper;

whereby rotation of said bolt about said longitudinal axis moves said clamp member towards and away from said keeper, said bolt having a plurality of threads received in said keeper and said clamp member for rotation of said bolt about the longitudinal axis.

17. The clamp assembly according to claim 16 wherein said clamp member is restrained against rotational movement about said longitudinal axis relative to said keeper.

18. The clamp assembly according to claim 16 wherein said saddle includes first and second contoured ends defined by a base therebetween.

19. The clamp assembly according to claim 16 wherein said keeper includes a substantially curved surface opposite said saddle, said curved surface configured to receive a conductor.

20. The clamp assembly according to claim 16 wherein said saddle includes outwardly flaring end sections curved away from an electrical conductor.

21. The clamp assembly according to claim 16 wherein said first and second sliding arms are cantilevered and attached to said clamp member at interior ends thereof and open at opposing exterior ends thereof.

* * * * *